US005080339A

United States Patent [19]

Hirahara

[11] Patent Number: 5,080,339

[45] Date of Patent: Jan. 14, 1992

[54] FOLDING MACHINE OF A ROTARY PRESS

[75] Inventor: Hidefumi Hirahara, Mihara, Japan

[73] Assignee: Mitsubishi Jukogyo Kabushiki Kaisha, Tokyo, Japan

[21] Appl. No.: 527,731

[22] Filed: May 23, 1990

[30] Foreign Application Priority Data

May 29, 1989 [JP] Japan ..... 1-132577
Jun. 12, 1989 [JP] Japan ..... 1-146684
Aug. 17, 1989 [JP] Japan ..... 1-210577

[51] Int. Cl.[5] ..... B42C 1/00

[52] U.S. Cl. ..... 270/21.1; 493/444; 493/445; 270/50

[58] Field of Search ..... 270/45, 46, 47, 48, 270/49, 50, 21.1; 493/419, 442, 444, 445, 454

[56] References Cited

U.S. PATENT DOCUMENTS 1,937,453 11/1933 Wood .
1,985,917 1/1935 Crafts .
4,190,242 2/1980 Bolza-Schunemann ..... 270/50

FOREIGN PATENT DOCUMENTS 1231723 1/1967 Fed. Rep. of Germany .
255351 7/1926 United Kingdom ..... 270/50
384680 12/1932 United Kingdom .
386004 1/1933 United Kingdom ..... 270/50

*Primary Examiner*—Edward K. Look
*Assistant Examiner*—Therese M. Newholm
*Attorney, Agent, or Firm*—Wenderoth, Lind & Ponack

[57] ABSTRACT

A folding machine of a rotary press is of the type that after superposed paper sheets have been cut out by means of a folding drum and a cutting drum, a folding blade is projected from the folding drum to insert the cut paper sheets between a pair of folding rollers for folding. A gap adjusting device for the folding rollers is composed of a pair of support arms for the folding rollers which are swingable about a pair of fixed shafts. Vertically movable adjusting tables are disposed under the respective support arms and a pair of links connect the adjusting tables with the respective support arms. In a variation a pair of arms pivotably supporting the folding rollers are coupled via a pair of adjusting levers pivotably supported from a single support shaft disposed under a middle portion of the support shafts of the arms and links. According to a third aspect, the respective folding rollers and the gap adjusting device for the folding rollers are mounted on a common support table, and the support table is supported so as to be movable with respect to the folding drum in the radial direction thereof.

18 Claims, 7 Drawing Sheets

FIG. 10
PRIOR ART
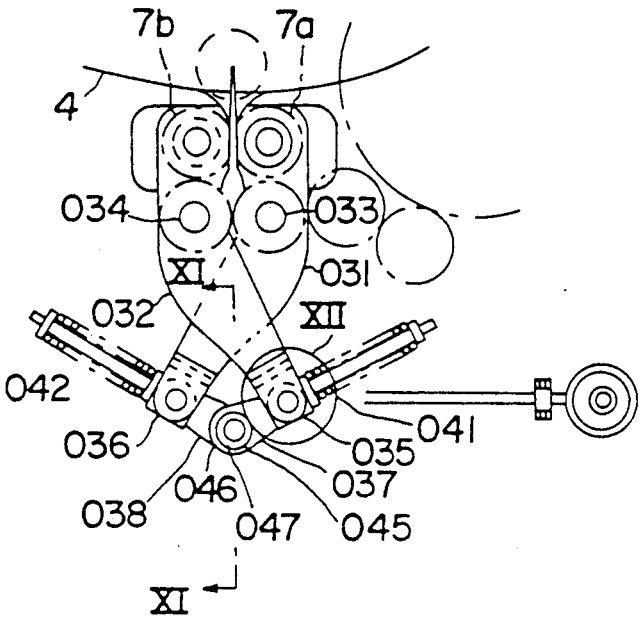
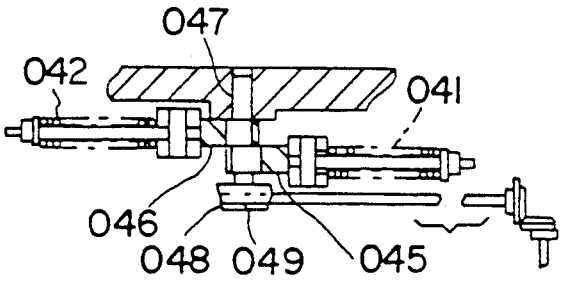
FIG. 11
PRIOR ART
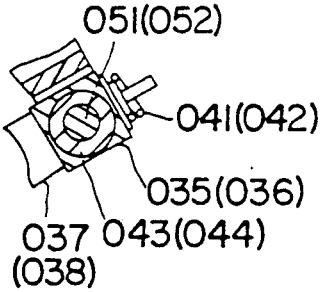
FIG. 12
PRIOR ART

FOLDING MACHINE OF A ROTARY PRESS

BACKGROUND OF THE INVENTION

1. Field of the Invention

The present invention relates to a folding machine of a rotary press of the type that after superposed paper sheets have been cut out by means of a folding drum and a cutting drum, a folding blade is projected from the same folding drum to insert the cut paper sheets between a pair of folding rollers for folding them.

2. Description of the Prior Art press in the prior art with reference to FIGS. 13 and 14, reference numeral 1 designates superposed paper webs formed by superposing a plurality of traveling paper webs, numeral 2 designates a pair of nipping rollers, numeral 3 designates a cutting drum, numeral 4 designates a folding drum, numeral 5 designates a folding blade provided in the same folding drum 4, numerals 7*a* and 7*b* designate a pair of folding rollers, numeral 9 designates a runner, and numeral 10 designates a paper sheet discharging conveyor. The arrangement is such that superposed paper webs 1 consisting of a plurality of traveling paper webs superposed on one another are led through a gap between the pair of nipping rollers 2 to a gap space between the cutting drum 3 and the folding drum 4, where they are cut into cut paper sheets 6. Subsequently, the folding blade 5 provided in the folding drum 4 is projected to insert a central portion of the cut paper sheets 6 into a gap space between the pair of folding rollers 7*a* and 7*b*. The paper sheets 6 are thereby pinched by these folding rollers 7*a* and 7*b* to form twice-folded portions 6*a* and 6*b* and to discharge them downwards through the gap clearance between the folding rollers 7*a* and 7*b*. Further, the twice-folded paper sheets are made to fall on the paper sheet discharging conveyor 10 via the runner 9 to be sent to a subsequent step.

In the folding machine of a rotary press shown in FIGS. 13 and 14, for the purpose of regularly performing folding of the cut paper sheets 6, it is necessary to adjust gap clearances Sa and Sb between the pair of folding rollers 7*a* and 7*b* and the folding blade 5 depending upon a number of completed pages, and to that end a gap adjusting device as shown in FIG. 9 is provided. Reference numeral 08 in FIG. 9 designates a screw shaft having both left-hand and right-hand threads 08*a* and 08*b*, and to this screw shaft 08 is transmitted the rotation of a motor or a handle 013 in a driving device via a coupling 014. When the screw shaft 08 rotates, joint members 015 restrained from rotation, would slide in the directions of arrows A and B jointly with adjusting nuts 018 which have female screws and threadedly engage the screw shaft 08. Hence arms 022*a* and 022*b* are rotated about fulcrum points at the center of support shafts 023*a* and 023*b* via links 021 and pins 024*a* and 024*b*, and thereby a gap space S between the folding rollers 7*a* and 7*b* is adjusted. It is to be noted that a spring 26 biases the joint members 015 so that they may be always butted against shoulder portions of the adjusting nuts 018.

As described above, while the gap adjusting device for the folding rollers shown in FIG. 9 is a device making use of a single spring 026, as one example of known prior art devices making use of two springs, a folding mechanism for use in a rotary press disclosed in Laid-Open Japanese Patent Specification No. 51-115120 (1976) is shown in FIGS. 10, 11 and 12 of this application. In this folding mechanism for use in a rotary press, blocks 035 and 036 are swingably supported via cushion rubbers 043 and 044 from tip end portions of sup port arms 032 and 031, respectively, which in turn support folding rollers 7*b* and 7*a*, respectively, and can rotate about support shafts 034 and 033, respectively. In addition, stop members 037 and 038 fit around eccentric cams 045 and 046 mounted to a shaft 047. At an axial end portion of the shaft 047 is fixed a worm wheel 048, which is adapted to be rotated by a worm 049. Hence as a result of rotation of the worm 049, the eccentric cams 045 and 046 rotate, thus the support arms 031 and 032 are rotated via the stop members 037 and 038 and the blocks 035 and 036, and the gap space S between the folding rollers 7*a* and 7*b* can be adjusted. At this time, the stop members 037 and 038, the blocks 035 and 036 and springs 041 and 042, respectively, would move integrally.

However, in the gap adjusting device for the folding rollers in the prior art shown in FIG. 9, in the event that a deviated load has been applied to the device, the respective folding rollers would mutually affect each other via the springs such that the respective folding rollers would rotate and vibrate. Therefore, normally an arm on one side (the arm 022*b* in FIG. 9) is fixed. But if the gap space between the respective folding rollers is made smaller than the thickness of the paper sheets for the completed pages in order to insure the folding, since the gap space between the fixed side folding roller and the folding blade is small, breaking or damages may be produced in the paper sheets and thus just the opposite effect would be brought about. Therefore, it is practically impossible to reduce the gap space between the respective folding rollers up to a gap distance smaller than the paper sheet thickness of the completed pages, and a high precision setting of the gap space between the respective folding rollers is required.

On the other hand, in the heretofore known folding mechanism for use in a rotary press shown in FIGS. 10, 11 and 12, in the case where it is necessary to make the arms large, the mass of the arms also become large, hence a shock upon the operation is large. Countermeasures for enhancing the mechanical strength, preventing abrasion and lowering the noise level become necessary. In view of this necessity, in the folding mechanism for use in a rotary press shown in FIGS. 10, 11 and 12, special cushion rubbers 043 and 044 are mounted to the shafts 051 and 052 for connecting the support arms 032 and 031 with the stop members 037 and 038. However, since they are elastic bodies, they would plastically deform, and the preset gap space would change. In addition, since the adjustment of the gap space is performed by means of eccentric cams, a worm wheel and a worm for driving the eccentric cams, the cam shaft would rotationally vibrate as the result of an impact force. Hence, the worm wheel and the worm are liable to generate surface peel at their contact surfaces. Moreover, in the event that the machine is operated with the gap space preset to be small with respect to the number of completed pages in order to form a fold in a group of thickly superposed sheets, there were problems in that response characteristics of the folding rollers, which continuously and periodically pinch paper sheets, would be deteriorated, the pressing would become unreliable and the pressing force would become insufficient because the mass and inertia of the arms are large, as described above.

In addition, in the case where a number of completed pages is large (thick pages), a fold was barely formed at the boundary between the twice-folded portion 6*a* and the twice-folded portion 6*b* by merely adjusting the above-mentioned gap space between the pair of folding rollers 7*a* and 7*b* with the aid of the gap adjusting device for folding rollers in the prior art as shown in FIG. 9. Therefore, the folding machine was stopped and the folding blade 5 was adjusted in such manner that a distance Ak (See FIG. 6) between the tip end of the folding blade 5 and the straight line connecting the centers of the pair of folding rollers 7*a* and 7*b* may become larger than a corresponding distance An (See FIG. 7) in the case of a small number of completed pages (thin pages).

However, in a recent rotary press, the number of completed pages of paper sheets is increasing and the page number difference between thick pages and thin pages is expanding. Accordingly, even if the gap space between the folding rollers 7*a* and 7*b* is adjusted with the position of the tip end of the folding blade 5 held at the position corresponding to thin pages, the state shown in FIG. 8 occurs. Hence when superposed paper sheets 6 having thick pages are folded, a fold is not given to the paper sheet on the outside, and the tip end portion at the location to be folded would come out of the folding machine in a swelled condition. Consequently, when the folded paper sheets are stacked up in a subsequent processing apparatus, for instance, on a paper sheet discharging conveyor 10, they would fall down. If one intended to forcibly form a fold with the pressing force of the folding rollers 7*a* and 7*b* being increased by strengthening the resilient forces of the springs (for instance, the spring 026 in FIG. 9 or the springs 041 and 042 in FIGS. 10–12), merely the forces for pressing the side surface of the folded paper sheets are increased and a fold is not formed. On the contrary the paper sheets are damaged by the folding rollers 7*a* and 7*b*, resulting in faults in quality. In the case where superposed paper sheets 6 having thin pages are folded with the tip end portion of the folding blade 5 kept adjusted at the position corresponding to thick pages as shown in FIG. 7, even if the gap space between the folding rollers 7*a* and 7*b* is adjusted, the superposed paper sheets 6 cannot be forcibly inserted into the gap space between the folding rollers 7*a* and 7*b*, and this causes stopping of paper sheets. For the above reasons, it is necessary to adjust the position of the tip end of the folding blade 5 with respect to the folding rollers 7*a* and 7*b* according to the completed pages, but this adjustment requires skill. In addition, since the above-mentioned adjustment is carried out after stopping the folding machine, there is a problem in that the rate of operation of the rotary press is lowered.

SUMMARY OF THE INVENTION

The present invention has been worked out in view of the aforementioned problems in the prior art, and one object of the present invention is to provide an improved folding machine of a rotary press in which folding can be effected reliably, good folds can be formed, the quality of folded paper sheets can be improved, and troubles in an operation such as the stopping of paper sheets or the like can be prevented.

Another object of the present invention is to provide a novel moving device for folding rollers in a folding machine of a rotary press in which, in addition to eliminating faults in quality, the falling down of folded paper sheets on the subsequent processing device can be prevented and the rate of operation of the rotary press can be improved.

In order to achieve the aforementioned objects, and according to one feature of the present invention, in a folding machine of a rotary press of the type that after superposed paper sheets have been cut out by means of a folding drum and a cutting drum, a folding blade is projected from the folding drum to insert the cut paper sheets between a pair of folding rollers for folding them, a gap adjusting device for adjusting a gap space between the respective folding rollers is composed of a pair of support arms for the folding rollers which are swingable about a pair of fixed shafts disposed in parallel to the axes of the respective folding rollers. Vertically movable adjusting tables are disposed under the respective support arms for the folding rollers, and a pair of links connect the adjusting tables with the respective support arms for the folding rollers.

According to another feature of the present invention, in a gap adjusting device for folding rollers in a folding machine of a rotary press of the type wherein a pair of folding rollers are disposed in opposition to a projecting portion of a folding blade provided in a folding drum with an adjustable gap space therebetween, a pair of arms which respectively pivotably support the folding rollers are coupled via a pair of adjusting levers pivotably supported from a single support shaft disposed under a middle portion of the support shafts of the arms and links.

According to still another feature of the present invention, in a folding machine of a rotary press of the type wherein superposed paper sheets cut out by means of a folding drum and a cutting drum of the folding machine are twice-folded by projecting a folding blade provided in the folding drum of the folding machine of the rotary press into a gap space between a pair of folding rollers, the aforementioned respective folding rollers and a gap adjusting device for the folding rollers for adjusting the gap space between the respective folding rollers depending upon the number of sheets of the aforementioned superposed paper sheets are supported by a common support table. The support table is supported so as to be movable with respect to the aforementioned folding drum in the radial direction thereof.

According to the present invention, since the folding machine of a rotary press is constructed in the above-described manner, in a first aspect of the invention, the adjusting tables are raised or lowered and their movement is transmitted via the respective links to the respective support arms of the folding rollers, and the gap space between the respective folding rollers is adjusted by making the respective support arms of the folding rollers swing about respective fixed shafts.

Also, in a second aspect of the present invention, by adjusting the adjusting levers, the arms are adjusted via the links, and thereby the gap space between the folding rollers pivotably supported by the arms can be adjusted.

Still further, in a third aspect of the present invention, when paper sheets of thick pages are to be folded, a driving system for a support table is actuated in one direction to lower the support table and the respective folding rollers with respect to the folding drum. Thereby upon folding, component forces of the pressing forces of the respective folding rollers upon the boundary of the twice-folded portion of the superposed paper sheets. At that time, a folding gap space is adjusted by means of a gap space adjusting device for the folding rollers disposed on the support table, and thus the respective folding rollers are precisely set at a predetermined position to surely form a fold. On the other hand, when paper sheets of thin pages are to be folded, the driving system for the support table is actuated in the other direction, and thereby the support table and the respective folding rollers are raised with respect to the folding drum. The folded paper sheets are then folded while being surely held by pressing forces of the respective folding rollers acting upon the side surfaces of the paper sheets.

The above-mentioned and other objects, features and advantages of the present invention will become more apparent by reference to the following description of preferred embodiments of the invention taken in conjunction with the accompanying drawings.

BRIEF DESCRIPTION OF THE DRAWINGS

In the accompanying drawings:

FIG. 10 is a side view showing a folding mechanism in a rotary press in the prior art;

FIG. 11 is a vertical cross-sectional front view taken along line XI—XI in FIG. 10 as viewed in the direction of arrows;

FIG. 12 is an enlarged vertical cross-section side view of the portion encircled by line XII;

DESCRIPTION OF THE PREFERRED EMBODIMENTS

Figure 1:
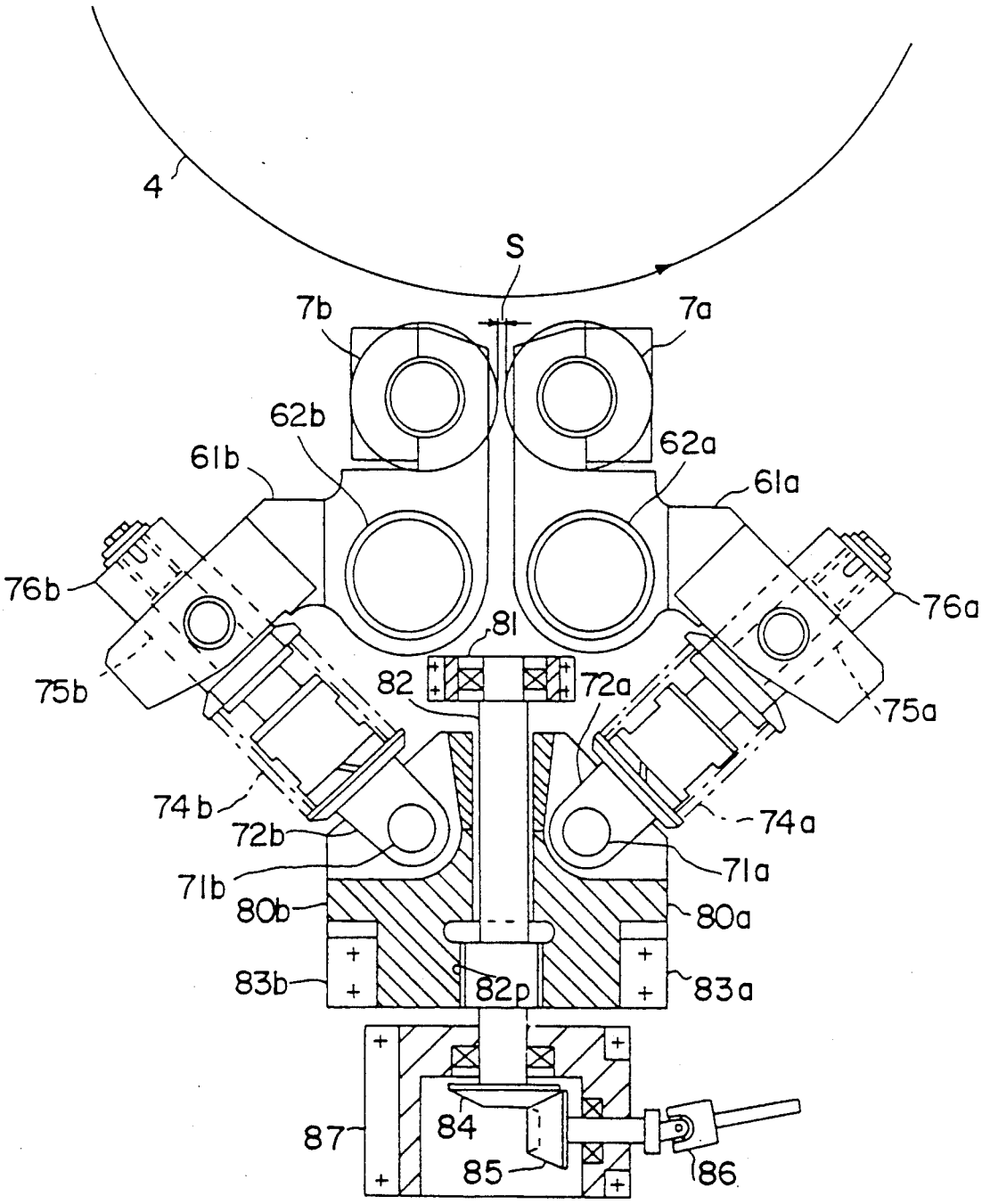
FIG. 1 is a side view partly in vertical cross-section of a first preferred embodiment of the present invention.

A first preferred embodiment of the present invention is illustrated in FIG. 1. In this figure, reference numeral 4 designates a folding drum, numerals 7*a* and 7*b* designate a pair of folding rollers, numerals 61*a* and 61*b* designate a pair of support arms for the folding rollers, numerals 62*a* and 62*b* designate a pair of fixed shafts which are in parallel to the axes of the respective folding rollers 7*a* and 7*b*, and the folding roller support arms 61*a* and 61*b* are swingably supported by the fixed shafts 62*a* and 62*b*. In addition, reference numerals 72*a* and 72*b* designates a pair of links, the lower end portions of these links 72*a* and 72*b* are rotatably supported by shafts 71*a* and 71*b* of vertically movable adjusting tables 80*a* and 80*b*, and stoppers 76*a* and 76*b* are fixedly secured to the upper end portions of the links 72*a* and 72*b*. Also, joints 75*a* and 75*b* slidably fit around shaft portions of the links 72*a* and 72*b*, respectively, and the above-mentioned folding roller support arms 61*a* and 61*b* are swingably mounted to the joints 75*a* and 75*b*, respectively. Springs 74*a* and 74*b* are interposed between the links 72*a* and 72*b* and the joints 75*a* and 75*b* are urged against the stoppers 76*a* and 76*b*, respectively. Consequently, the folding rollers 7*a* and 7*b* are pressed against the paper sheets at positions corresponding to an adjusted gap space by the resilient forces of the springs 74*a* and 74*b*. If any external forces should act upon the folding rollers 7*a* and 7*b*, then the springs 74*a* and 74*b* would deform and the joints 75*a* and 76*a* would collide against the stoppers 76*a* and 76*b*, but as the lengths of the folding roller support arms 61*a* and 61*b* are short and their mass is also small, an impulsive force exerted at that time is small, and hence special cushion members are unnecessary. In addition, reference numeral 87 designates a base table, numerals 84 and 85 designate bevel gears rotatably mounted to the base table 87, and these bevel gears are meshed with each other. Reference numeral 86 designates a universal joint for connecting a rotary shaft on the side of a handle (not shown) with a rotary shaft of the above-mentioned bevel gear 85, reference numeral 82*p* designates a screw shaft formed integrally with the above-described bevel gear 84, and this screw shaft 82*p* is threadedly engaged with the above-mentioned adjusting tables 80*a* and 80*b*. Reference numerals 83*a* and 83*b* designate guide members for guiding vertical movement of the aforementioned adjusting tables 80*a* and 80*b*.

Now, an operation of the folding machine of the rotary press shown in FIG. 1 will be explained in detail. The handle (not shown) is rotated, its rotation is transmitted to the screw shaft 82*p* by the universal joint 86. The bevel gear 85 and the bevel gear 84 to rotate the screw shaft 82*p*, and thereby the adjusting tables 80*a* and 80*b* threadedly engaged with the screw shaft 82*p* are raised or lowered. Their movement is transmitted to the folding roller support arms 61*a* and 61*b* via the links 72*a* and 72*b*, and thus the folding roller support arms 61*a* and 61*b* are made to swing about the fixed shafts 62*a* and 62*b*, respectively, and the gap space S between the folding rollers 7*a* and 7*b* is adjusted.

Figure 2:
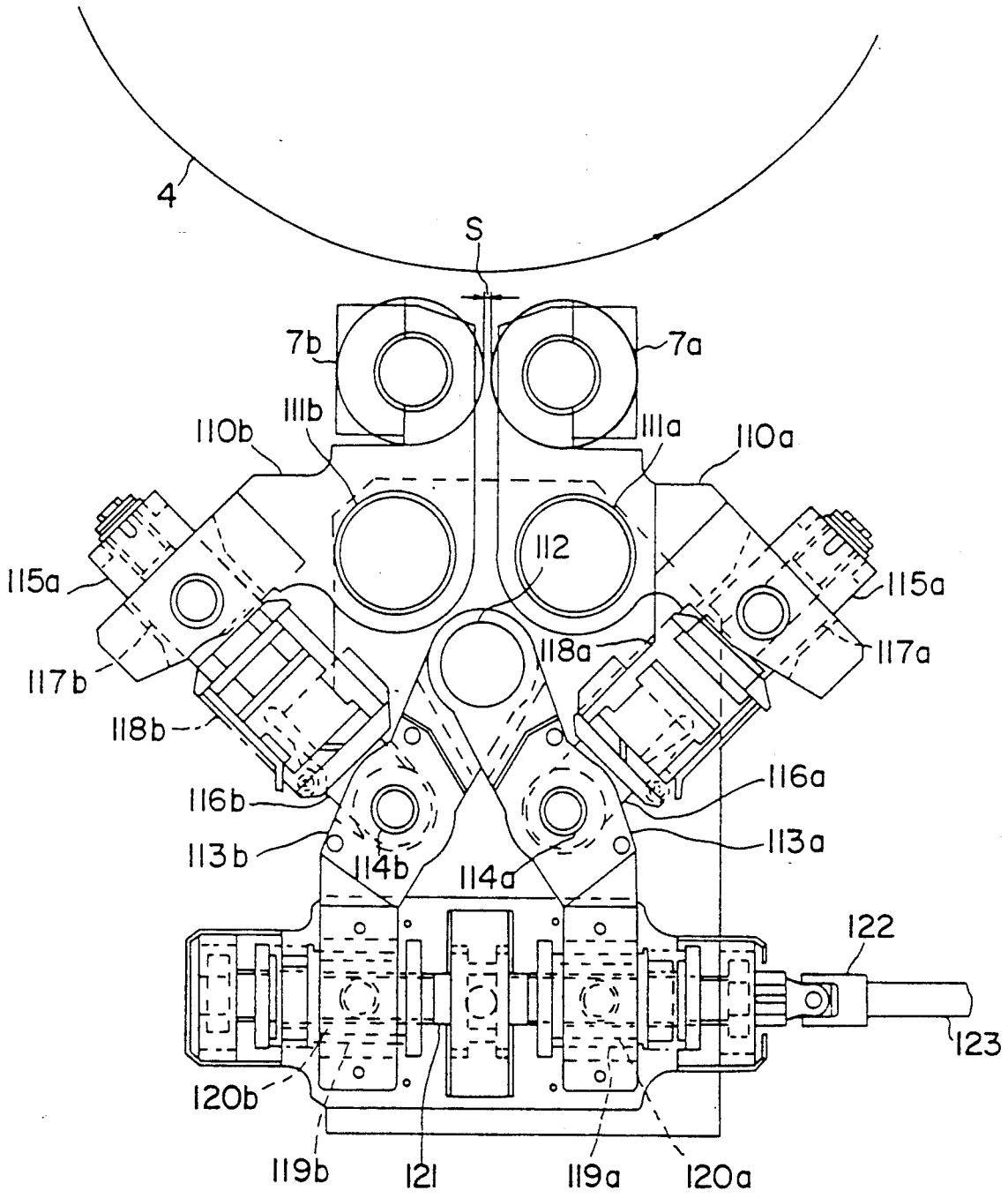
FIG. 2 is a side view of a second preferred embodiment of the present invention.
Figures 13, 14:
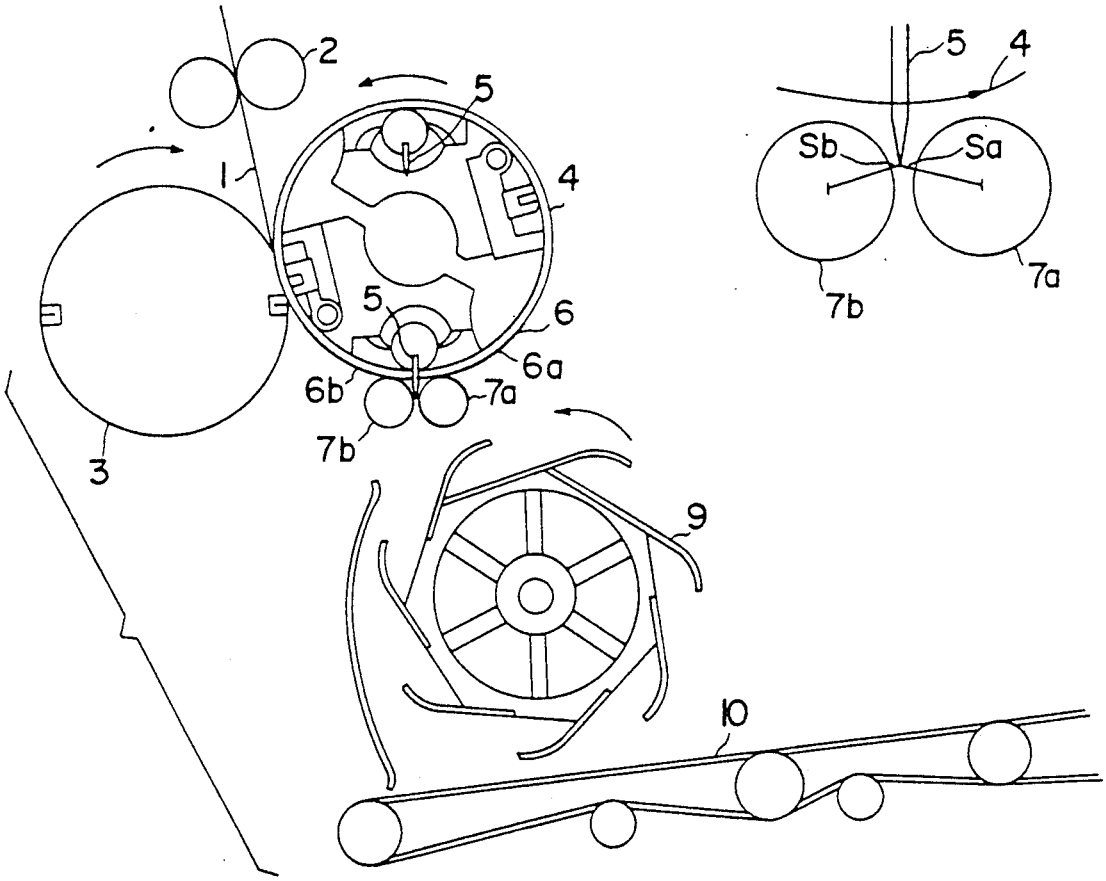
FIG. 13 PRIOR ART
FIG. 14 PRIOR ART
FIG. 13 is a schematic side view showing a folding machine of a rotary press in the prior art.
FIG. 14 is a schematic view showing a gap space formed between respective folding rollers and a folding blade.

Next, a second preferred embodiment of the present invention will be described with reference to FIG. 2. According to this preferred embodiment, like the folding machine in the prior art shown in FIG. 13, paper webs 1 consisting of a plurality of superposed running paper webs pass through a gap between a pair of nipping rollers 2, and are cut at the gap space between a cutting drum 3 and a folding drum 4. The cut paper sheets 6 have their central portion pushed down by a folding blade 5 disposed in the folding drum 4, the twice-folded portions 6*a* and 6*b* of the cut paper sheets 6 which have been pushed down are pinched by a pair of folding rollers 7*a* and 7*b*, and hence the cut paper sheets 6 are sent downwards in a folded state and are ejected onto a discharging conveyor 10 by means of a runner 9.

In order to achieve the folding regularly, it is necessary to adjust the gap space between the pair of folding rollers 7*a* and 7*b* and the folding blade 5 depending upon the number of completed pages. As shown in FIG. 2, a gap adjusting device for the folding rollers 7*a* and 7*b* in this preferred embodiment is comprised of a pair of arms 110*a* and 110*b* pivotably supporting the folding rollers 7*a* and 7*b*, a pair of adjusting levers 113*a* and 113*b* pivotably supported from a single support shaft 112 disposed under a middle portion of two support shafts 111*a* and 111*b* of the arms 110*a* and 110*b*, and links 116*a* and 116*b* each having one end pivotably supported from the adjusting levers 113*a* and 113*b* via shafts 114*a* and 114*b*, respectively, with stoppers 115*a* and 115*b* at the other ends thereof butted against the arms 110*a* and 110*b*. These links 116*a* and 116*b* have their axial rods inserted in joints 117*a* and 117*b* which are pivotably supported from the arms 110*a* and 110*b*, respectively, and the links 116*a* and 116*b* have their stoppers 115*a* and 115*b* resiliently butted against the outer side surfaces of the joints 117*a* and 117*b* by means of springs 118*a* and 118*b* provided between their swingable end portions and the joints 117*a* and 117*b*.

At the tip ends of the adjusting levers 113*a* and 113*b* are swingably mounted blocks 119*a* and 119*b*. The respective blocks 119*a* and 119*b* are threadedly engaged with adjusting screws 120*a* and 120*b* which are threaded with a right-hand screw and a left-hand screw, respectively. These adjusting screws 120*a* and 120*b* are screw-coupled to a screw shaft 121, and the screw shaft 121 is in turn connected to a rotary shaft 123 via a universal joint 122.

Thus, as a result of rotation of the rotary shaft 123, the adjusting levers 113*a* and 113*b* would swing respectively in the opposite directions. Due to the rotation of the adjusting levers the arms 110*a* and 110*b* would be rotated via the links 116*a* and 116*b*, respectively, to adjust the gap space between the folding rolls 7*a* and 7*b*, with the adjusted folding rolls 7*a* and 7*b* are pressed against the paper sheets by the resilient forces of the springs 118*a* and 118*b*. If the folding rolls 7*a* and 7*b* should vibrate due to any external forces, the springs 118*a* and 118*b* would somewhat deform and vibrate and impacts may arise between the joints 117*a* and 117*b* and the stoppers 115*a* and 115*b*. But since the arms 110*a* and 110*b* are short in length and small in mass, the amount of impacts is so small that a special cushion member is not necessitated.

Figure 3:
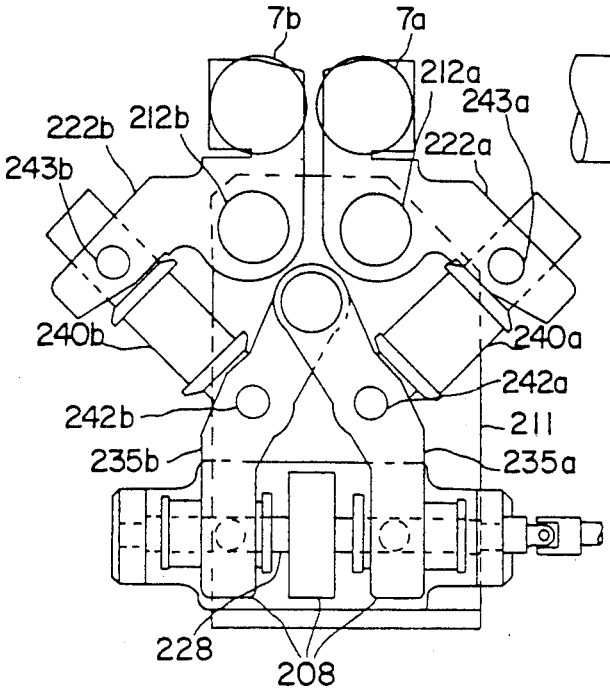
FIG. 3 is a side view of a third preferred embodiment of the present invention.
Figure 5:
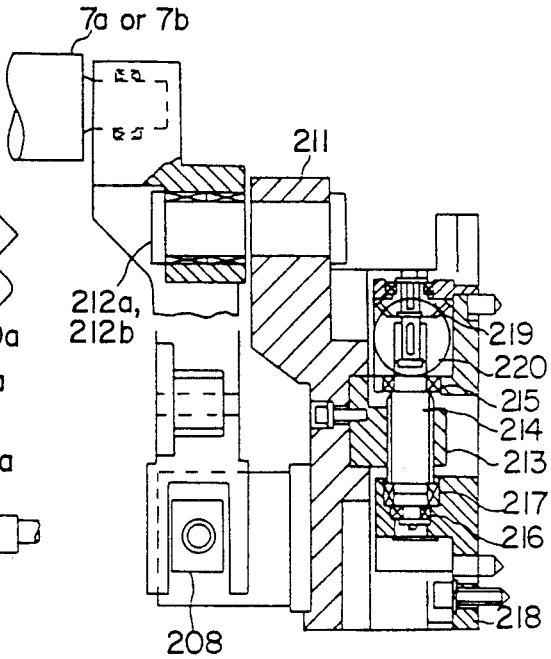
FIG. 5 is a vertical cross-sectional front view of the third preferred embodiment.
Figure 4:
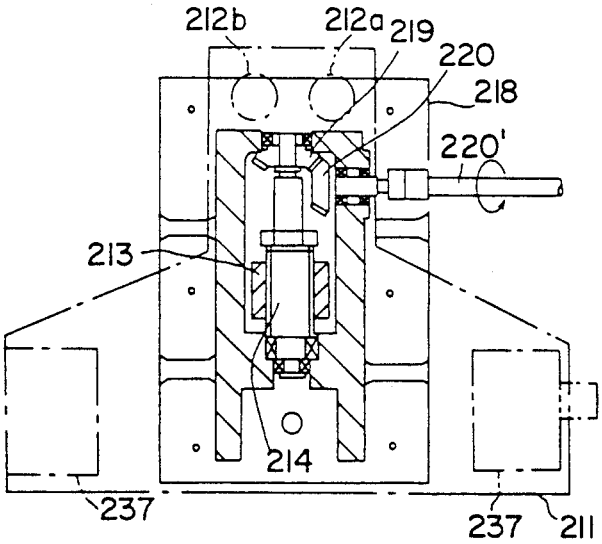
FIG. 4 is a vertical cross-sectional side view of the third preferred embodiment.
Figure 9:
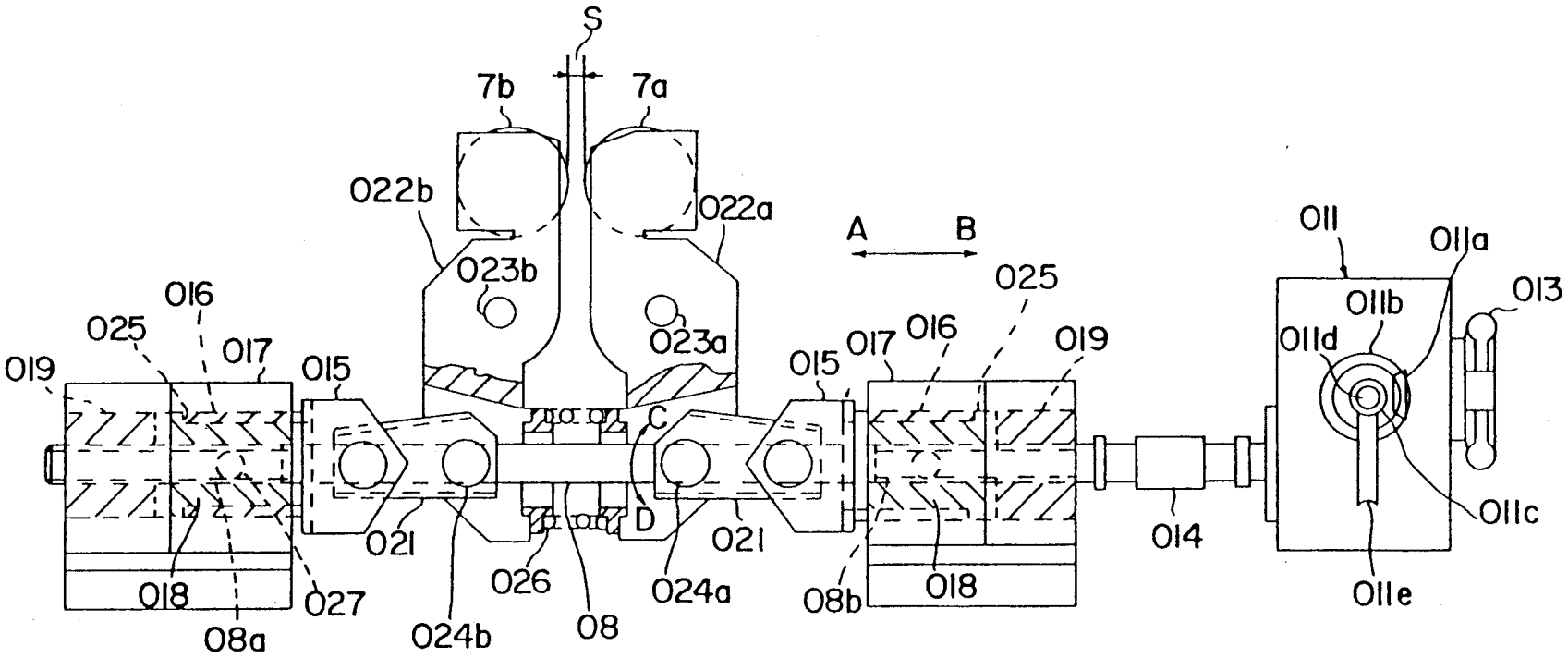
FIG. 9 PRIOR ART
FIG. 9 is a side view partly in vertical cross-section showing a gap adjusting device for folding rollers in the prior art.

Now a third preferred embodiment of the present invention will be described with reference to FIGS. 3 to 5. In these figures, reference numeral 218 designates a fixed table and numeral 214 designates a screw shaft. The upper and lower portions of the screw shaft 214 are rotatably supported from the above-mentioned fixed table 218 via bearings 215 and 216 and a thrust bearing 217. Reference numeral 219 designates a bevel gear fixed to the upper end portion of the screw shaft 214, numeral 220 designates another bevel gear meshed with the aforementioned bevel gear 219, numeral 220' designates an adjusting shaft of a folding roller moving device which shaft is formed integrally with the bevel gear 220, and this adjusting shaft 220' extends from a handle or a motor (separate from the handle or motor of the gap adjusting device for the folding rollers) and is rotatably mounted to the fixed table 218. Reference numeral 213 designates a boss threadedly engaged with the screw shaft 214, numeral 211 designates a support table fixed to the boss 213 by means of bolts, numerals 7*a* and 7*b* designate a pair of folding rollers, numeral 208 designates a gap adjusting device for the folding rollers, and this gap adjusting device 208 has a similar construction to the folding roller gap adjusting device shown in FIG. 9 and described previously. More particularly, reference numeral 228 designates a screw shaft having left-hand threads and right-hand threads, numerals 235*a* and 235*b* designate rods threadedly engaged with the left-hand screw portion and the right-hand screw portion of the screw shaft 228 and restrained from rotation by means of guide members, and numerals 240*a* and 240*b* designate arms having their lower end portions pivotably supported by the respective rods 235*a* and 235*b* via pins 242*a* and 242*b*, respectively. Reference numerals 222*a* and 222*b* designate roller support arms, numerals 212*a* and 212*b* designate shafts for pivotably supporting the roller support arms 222*a* and 222*b* on the above-mentioned support table 211, and the upper portions of the aforementioned arms 240*a* and 240*b* are pivotably supported by the roller support arms 222*a* and 222*b* via pins 243*a* and 243*b*, respectively.

In this preferred embodiment, rotation of a handle or a motor (for instance, the handle 33 in FIG. 9 or the like) is transmitted to the screw shaft 208 (a screw shaft having left-hand threads and right-hand threads) to rotate the screw shaft 208. The rods 235*a* and 235*b* threadedly engaged with the left-hand screw portion and the right-hand screw portion of the screw shaft 208 and restrained from rotation by means of guide members are thereby moved in the directions for approaching toward each other or separating from each other. The movements of these rods 235*a* and 235*b* are transmitted via the respective arms 240*a* and 240*b* to the roller support arms 222*a* and 222*b*, and hence the roller support arms 222*a* and 222*b* are made to swing about the shafts 212*a* and 212*b*, respectively, and thereby the gap space between the pair of folding rollers 7*a* and 7*b* can be adjusted depending upon the number of completed pages.

Figure 6:
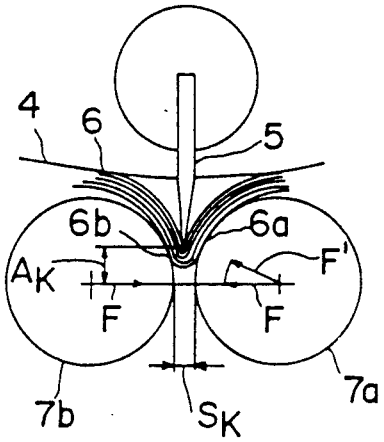
FIG. 6 is a schematic view explaining an operation of folding superposed paper sheets of thick pages.
Figure 7:
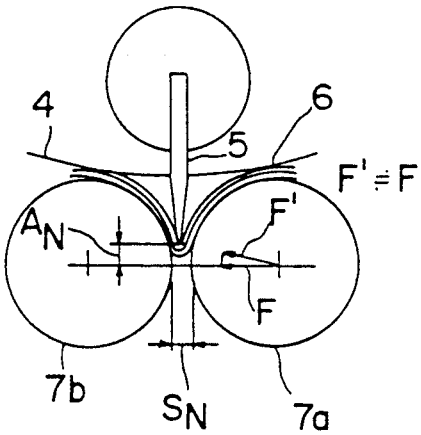
FIG. 7 is a schematic view explaining an operation of folding superposed paper sheets of thin pages.
Figure 8:
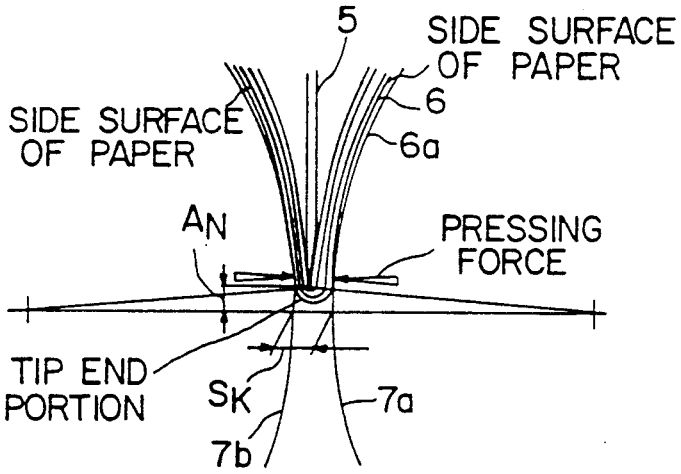
FIG. 8 is a schematic view for illustrating pressing forces of folding rollers.

Now an operation of the folding roller moving device in the folding machine of the rotary press shown in FIGS. 3, 4 and 5 will be described in detail. When superposed paper sheets 6 of thick pages are to be folded as shown in FIG. 6, the adjusting shaft 220' of the folding roller moving device is rotated in one direction by a handle or a motor. The rotation is transmitted via the bevel gear 220 and the bevel gear 219 to the screw shaft 214 to rotate the screw shaft 214 in one direction, and thereby the boss 213, the support table 211 and the folding rollers 7*a* and 7*b* are lowered. Then, as shown in FIG. 6, component forces F' of the pressing forces of the folding rollers 7*a* and 7*b* act upon the boundary of the twice-folded portions 6*a* and 6*b* of the superposed paper sheets 6, and a fold is surely formed. Since a folding gap space Sk can be adjusted by means of the folding roller gap adjusting device 208 disposed on the support table 211 for the folding rollers 7*a* and 7*b*, the folding rollers 7*a* and 7*b* would be set precisely at predetermined positions, and thus folding can be achieved reliably. On the other hand, when superposed paper sheets 6 of thin pages are to be folded, as shown in FIG. 7, the adjusting shaft 220' of the folding roller moving device is rotated in the other direction by the handle or motor, the rotation is transmitted via the bevel gear 220 and the bevel gear 219 to the screw shaft 214 to rotate the screw shaft in the other direction, and thereby the boss 213, the support table 211 and the folding rollers 7*a* and 7*b* are raised. The superposed paper sheets 6 can then be folded while being surely held by the pressing forces of the folding rollers 7*a* and 7*b* acting upon the side surfaces of the paper sheets.

In the folding machine of a rotary press according to the present invention, since the adjusting table is raised or lowered, its movement is transmitted via the respective links to the respective folding roller support arms, and the respective folding roller support arms are made to swing about the respective fixed shafts and thereby the gap space between the respective folding rollers is adjusted as described above, response characteristics of the gap space adjustment are excellent, it is possible to operate the machine by presetting a gap space smaller than the number of completed pages depending upon a paper sheet thickness, folding can be achieved reliably, a good fold can be obtained, thus quality of the folded paper sheets can be improved, and moreover, troubles in operations such as stoppage of paper sheets can be prevented.

In addition, in the folding machine of a rotary press according to the present invention, since a pair of arms for pivotably supporting the folding rollers are connected via a pair of adjusting levers pivotably supported from a single support shaft disposed under a middle portion of the support shafts of the arms and a pair of links, the arms for pivotably supporting the rollers can be formed short and connected to the adjusting levers. Therefore a gap adjusting device which is small-sized and excellent in response characteristics can be provided. Accordingly, it is possible to operate the machine by presetting a gap space smaller than a number of completed pages depending upon a paper sheet thickness, folding can be achieved reliably, a good fold is formed, the quality of folded paper sheets is improved, and also troubles in operations such as stoppage of paper sheets can be prevented.

Furthermore, in the folding machine of a rotary press according to the present invention, as described above, when superposed paper sheets of thick pages are to be folded, a supporting table drive system is actuated in one direction to lower the supporting table and the respective folding rollers with respect to the folding drum, and thereby upon folding, component forces of the pressing forces of the respective folding rollers are made to act upon a boundary between the twice-folded portions of the superposed paper sheets. At that time, the folding gap space is adjusted by the folding roller gap adjusting device disposed on the support table, the respective folding rollers are preset precisely at predetermined positions, and thereby a fold can be formed reliably. On the other hand, when superposed paper sheets of thin pages are to be folded, the supporting table drive system is actuated in the other direction to raise the supporting table and the respective folding rollers with respect to the folding drum, and the superposed paper sheets are folded while being reliably held by the pressing forces of the respective folding rollers acting upon the side surfaces of the paper sheets. Therefore, it would not occur that the superposed paper sheets are damaged by the respect folding rollers or a fold cannot be formed. Thus faults in quality can be eliminated, and the folded paper sheets are prevented from falling from the subsequent processing device. In addition, gap adjustment of the respective folding rollers and movement of the supporting table can be carried out during operation of a rotary press, and so there is an advantage in that the rate of operation of a rotary press can be improved.

While a principle of the present invention has been described above in connection to preferred embodiments of the invention, it is intended that all matter contained in the above description and illustrated in the accompanying drawings shall be interpreted to be illustrative and not as a limitation to the scope of the invention.

What is claimed is:

1. A folding machine for a rotary press comprising a cutting drum and a folding drum for cutting superposed paper sheets, a pair of folding rollers for folding the superposed paper sheets, a folding blade projected from said folding drum for inserting the superposed paper sheets between said pair of folding rollers and a gap adjusting device for adjusting a gap space between said pair of folding rollers, said gap adjusting device comprising:

a pair of support arms, each said support arm mounting a respective said folding roller thereon, and each said support arm being pivotably mounted on a fixed shaft, said shafts being disposed parallel to the axes of said folding rollers;

vertically movable adjusting tables disposed below respective said support arms; and a pair of links connecting said adjusting tables with their respective said support arms.

2. The folding machine of claim 1, wherein springs resiliently connect said links with said support arms.

3. The folding machine of claim 1, wherein said vertically movable adjusting tables have a moving means for vertically moving said tables, whereby vertical movement of said tables causes said links to move said support arms to adjust said gap space between said pair of folding rollers.

4. The folding machine of claim 3, wherein each said link is pivotably connected to both a respective said support arm and a respective said vertically movable adjusting table.

5. The folding machine of claim 4, wherein each said support arm has a pivot connection pivotably connecting said support arms to its respective said link extending in one direction from its said fixed shaft and a folding roller mounting portion mounting a said folding roller extending in another direction from said fixed shaft.

6. The folding machine of claim 4, wherein each said support arm has a pivot connection pivotably connecting said support arm to its respective said link and each said link has a stop and a spring biasing said pivot connection of said support arm against said stop.

7. The folding machine of claim 3, wherein said moving means comprises a threaded shaft threadedly engaging said tables for vertical movement of said tables upon rotation of said shaft.

8. A gap adjusting device for adjusting a gap space between a pair of folding rollers in a folding machine of a rotary press, comprising:

a pair of pivotably mounted support arms, each pivotably mounted on a respective mounting shaft, and each supporting a respective folding roller, said arms being pivotable on said mounting shafts to adjust the gap space between said folding rollers;

a pair of adjusting levers both pivotably connected to a common single support shaft, said support shaft being disposed below and halfway between said mounting shafts of said support arms; and a pair of links connecting each said adjusting lever with a respective said support arm.

9. The gap adjusting device of claim 8, and further comprising means for pivoting said adjusting levers about said common single support shaft to move said links and said support arms to adjust the gap space between said folding rollers.

10. The gap adjusting device of claim 9, wherein said means for pivoting comprises blocks pivotably connected to respective end portions of said adjusting levers and an adjusting screw having right-hand threads and left-hand threads threadedly engaged with respective said blocks.

11. The gap adjusting device of claim 10, wherein each said support arm has a pivot connection pivotably connecting said support arm to its respective said link and each said link has a stop and a spring biasing said pivot connection of said support arm against said stop.

12. The gap adjusting device of claim 8, wherein each said support arm has a pivot connection pivotably connecting said support arm to its respective said link and each said link has a stop and a spring biasing said pivot connection of said support arm against said stop.

13. The gap adjusting device of claim 8, wherein each said link is pivotably connected to both a respective said support arm and a respective said adjusting lever.

14. The gap adjusting device of claim 13, wherein each said support arm has a pivot connection pivotably connecting said support arm to its respective said link and each said link has a stop and a spring biasing said pivot connection of said support arm against said stop.

15. A folding machine for a rotary press comprising a cutting drum and a folding drum for cutting superposed paper sheets, a pair of folding rollers for folding the superposed paper sheets, a folding blade projected from said folding drum for inserting the superposed paper sheets between said pair of folding rollers and a gap adjusting device for adjusting a gap space between said pair of folding rollers, said folding machine further comprising:

a support table, both said folding rollers and said gap adjusting device being mounted on said support table; and means for movably supporting said support such that said support table is movable relative to said folding drum in the radial direction thereof.

16. The folding machine of claim 15, wherein said means for movably supporting said support table comprises a fixed table fixed relative to said folding drum and a moving arrangement for supporting and moving said support table on said fixed table.

17. The folding machine of claim 16, wherein said moving arrangement includes a boss fixed to said support table threadedly engaged with a screw shaft rotatably mounted in said fixed support.

18. The folding machine of claim 17, wherein said moving arrangement further includes a turning mechanism for turning said screw shaft.

* * * * *